US006840300B2

(12) United States Patent
Lewis, Jr.

(10) Patent No.: US 6,840,300 B2
(45) Date of Patent: Jan. 11, 2005

(54) TRACK GUARD FOR A SECTIONAL OVERHEAD DOOR ASSEMBLY

(75) Inventor: Richard J. Lewis, Jr., Loveland, OH (US)

(73) Assignee: Clopay Building Products R&D Company, Inc., Cincinnati, OH (US)

( * ) Notice: Subject to any disclaimer, the term of this patent is extended or adjusted under 35 U.S.C. 154(b) by 41 days.

(21) Appl. No.: 10/170,298

(22) Filed: Jun. 12, 2002

(65) Prior Publication Data

US 2003/0230036 A1 Dec. 18, 2003

(51) Int. Cl.[7] ..... E05D 15/06

(52) U.S. Cl. ..... 160/201; 160/40; 49/460; 49/197; 52/98; 52/100

(58) Field of Search ..... 52/98, 99, 100; 49/460, 383, 199, 198, 197, 425; 160/201, 40

(56) References Cited

U.S. PATENT DOCUMENTS

| | | | | | |
|---|---|---|---|---|---|
| 3,412,780 | A | | 11/1968 | Moler | 160/191 |
| 3,788,678 | A | | 1/1974 | Switzgable | 292/7 |
| 3,967,671 | A | | 7/1976 | Stanley et al. | 160/232 |
| 4,119,133 | A | | 10/1978 | Wolf | 160/209 |
| 4,938,273 | A | | 7/1990 | Dubbelman et al. | 160/201 |
| 5,172,744 | A | | 12/1992 | Finch et al. | 160/133 |
| 5,337,520 | A | | 8/1994 | Uribe | 49/197 |
| 5,441,230 | A | * | 8/1995 | Sambleson | 248/495 |
| 5,887,385 | A | | 3/1999 | Horner et al. | 49/26 |
| 5,927,368 | A | | 7/1999 | Rohrer et al. | 160/201 |
| 5,954,111 | A | | 9/1999 | Ochoa | 160/201 |
| 6,053,235 | A | * | 4/2000 | Ruffner, Sr. | 160/89 |
| 6,059,005 | A | * | 5/2000 | Zinbarg | 160/90 |
| 6,076,589 | A | | 6/2000 | Hörmann | 160/201 |
| 6,125,506 | A | | 10/2000 | Martin | 16/91 |
| 6,227,281 | B1 | | 5/2001 | Martin | 160/201 |
| 6,289,966 | B1 | | 9/2001 | Hoermann | 160/191 |
| 6,374,567 | B1 | * | 4/2002 | Mullet | 52/716.1 |
| 6,435,604 | B2 | * | 8/2002 | Gaeta | 296/202 |
| 6,527,035 | B2 | * | 3/2003 | Hoofard et al. | 160/201 |
| 6,540,003 | B1 | * | 4/2003 | Martin | 160/201 |
| 6,553,618 | B2 | * | 4/2003 | Whitley | 16/91 |
| 6,554,047 | B1 | * | 4/2003 | Mondragon et al. | 160/201 |

FOREIGN PATENT DOCUMENTS

| | | | |
|---|---|---|---|
| DE | 33 31 968 | 3/1985 | E05D/17/00 |
| EP | 1 108 849 | 6/2001 | E06B/3/48 |
| EP | 1 116844 | 7/2001 | E05D/15/38 |
| WO | WO 98/30776 | 7/1998 | E05D/15/24 |
| WO | WO 00/15936 | 3/2000 | E05D/15/06 |

OTHER PUBLICATIONS

Document Bibliography and Abstract of DE 33 31 968, *Catch Device for Up–and–Over Door Wings*, esp@cenet.com, Aug., 2002.

* cited by examiner

*Primary Examiner*—Carl D. Friedman
*Assistant Examiner*—Chi Q. Nguyen
(74) *Attorney, Agent, or Firm*—Wood, Herron & Evans, LLP

(57) ABSTRACT

A track guard for a sectional overhead door assembly comprises an elongate member which may be positioned between the vertical track sections of the door assembly and a wall jamb to which the vertical track sections are mounted to cover the space therebetween. The track guard has a generally C-shaped cross-section and has a width which tapers from a first end to a second end to accommodate variations in spacing between the vertical track sections and the wall jamb.

26 Claims, 3 Drawing Sheets

TRACK GUARD FOR A SECTIONAL OVERHEAD DOOR ASSEMBLY

FIELD OF THE INVENTION

This invention pertains generally to overhead doors, and more particularly to an improvement to a sectional overhead door for increasing the pinch resistance of the door.

BACKGROUND OF THE INVENTION

Sectional overhead doors are commonly used for the closing the opening of a building, such as a garage, a warehouse, a store, or other similar buildings. Conventional sectional overhead doors are constructed from a series of sectional door panels which are pivotally coupled together along parallel longitudinal edges of the door panels to form an articulating unit. A series of rollers extend from each lateral edge of the door panels. The overhead door assembly further includes a track assembly having substantially vertical track sections adjacent opposite sides of the opening of the building, and substantially horizontal track sections extending above an upper portion of the vertical track sections. Arcuate transition track sections span between the vertical and horizontal track sections to provide a continuous length of track on opposite sides of the opening. The door is mounted in the track assembly such that the rollers are captured by the track sections, whereby the door may be moved between a generally vertical, closed position covering the opening of the building to a generally horizontal, open position exposing the opening of the building. The vertical track sections are generally attached by brackets to a wall jamb which surrounds the opening in the building. The horizontal track sections may be suspended by brackets attached to a ceiling above the horizontal track sections. The vertical track sections are generally inclined in a direction which increases the spacing between the vertical track section and the wall jamb toward an upper portion of the vertical track section, to facilitate engagement of the door with the wall jamb when the door is moved from an open position to a closed position.

In many conventional sectional overhead door assemblies, a space, or gap, exists between the wall jamb and the vertical track section, creating a potential area where objects, including the hands and limbs of a person near the overhead door, may be pinched between the door and the wall jamb as the door moves from an open position to a closed position. This may occur if an object falls into the space between the vertical track section and the wall jamb, or if a person extends a limb into that space.

There is thus a need for an improved sectional overhead door assembly which prevents objects or limbs from being inserted into the space between the vertical track section and the wall jamb.

SUMMARY OF THE INVENTION

The present invention provides an apparatus and method for covering the space between a wall jamb and a vertical track section of a sectional overhead door assembly to improve the pinch resistance of the door assembly. In an exemplary embodiment, a track guard may be installed to a sectional overhead door assembly upon initial installation of the door assembly to cover an opening of a building structure. In another exemplary embodiment, the track guard may be added to an existing sectional overhead door to improve its pinch resistance. The track guard is positioned between the vertical track section of an overhead door assembly and the wall jamb to prevent the extension of objects or limbs into that space. The track guard does not support the weight of the vertical track section nor capture the rollers on the door panels, but it is attached to the brackets which mount the vertical track section to the wall jamb. Since the track guard does not capture the rollers or support the weight of the door, it is readily added to an existing sectional door installation.

In another exemplary embodiment, the track guard is an elongate member formed from high impact polystyrene and having a generally C-shaped cross section. The track guard has a width which tapers in a direction along its length, to accommodate the variation of spacing between the vertical track section and the wall jamb.

In another exemplary embodiment, a method of installing a sectional overhead door assembly includes the steps of attaching mounting brackets to a wall jamb near an opening of a building, attaching a vertical track section to the mounting brackets, mounting a sectional door to a track assembly which includes the vertical track section, positioning a track guard to cover a space between the vertical track section and the wall jamb, and attaching the track guard to the mounting brackets.

The features and objectives of the present invention will become more readily apparent from the following Detailed Description taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
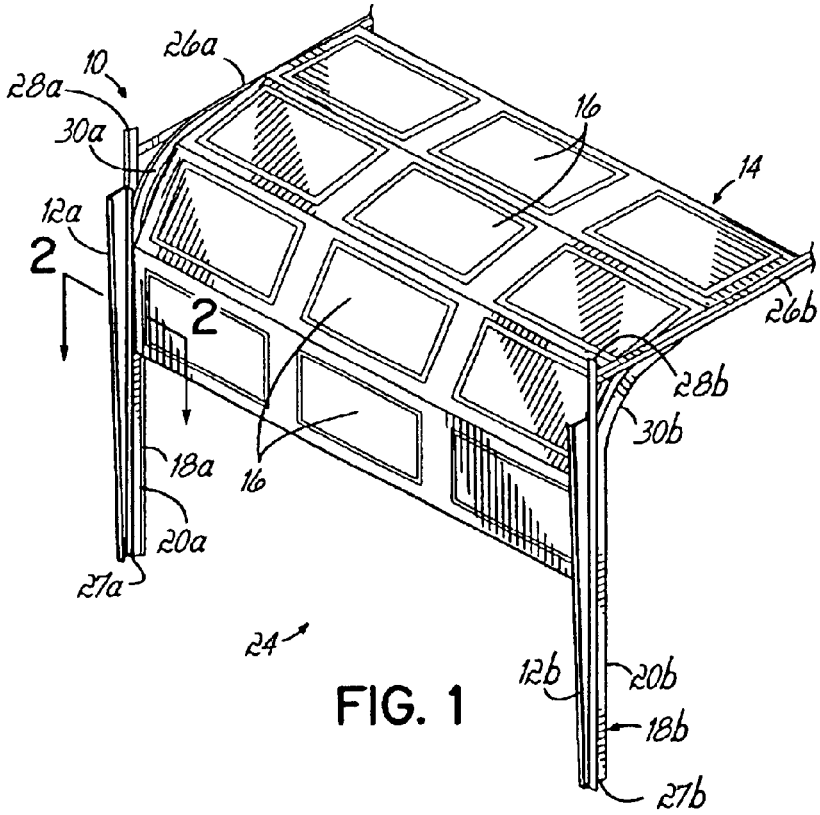
FIG. 1 is a perspective view depicting a sectional overhead door assembly, including exemplary track guards of the present invention.

Referring to FIG. 1, a sectional overhead door assembly 10 including exemplary track guards 12*a*, 12*b* of the present invention is shown. The sectional overhead door assembly 10 includes a sectional door 14 made up of several door panels 16 which are pivotally connected along upper and/or lower longitudinal edges of the panels to create an articulating door unit. The door assembly 10 further includes a track system 18*a*, 18*b* which includes a pair of vertical track sections 20*a*, 20*b* which may be mounted to a wall jamb 22 (see FIG. 2) on opposite sides of an opening 24 to a building. The track system 18 further includes a pair of generally horizontal track sections 26*a*, 26*b* which are positioned at upper ends 28*a*, 28*b* of the vertical track sections 20*a*, 20*b* and which may be suspended from structure above the horizontal track sections 26*a*, 26*b*, such as the ceiling of the building. A pair of arcuate transition track sections 30*a*, 30*b* connect the upper ends 28*a*, 28*b* of the vertical track sections 20*a*, 20*b* to the horizontal track sections 26*a*, 26*b* to form a pair of oppositely facing tracks running vertically along the opposite side edges of the opening 24 and extending horizontally above and behind the opening 24. The vertical track sections 20*a*, 20*b* are attached to the wall jamb 22 by mounting brackets 32 which are generally spaced at intervals along the length of the vertical track sections 20*a*, 20*b*. Three such mounting brackets 32 are shown in FIG. 3 with the uppermost mounting bracket 32 being in the form of a flag bracket to which the upper end of the vertical track section 20 and the arcuate track section 30 are attached. However, the specific number and design of the mounting brackets are not limitations on this invention.

The sectional door panels 16 have a series of rollers 34 extending from the lateral ends of the panels 16 whereby the door 14 is mounted in the track assembly 18 such that the rollers 34 are captured by the track sections 20, 26, 30. The door may thus be moved along the track assembly 18 between a generally vertical position to cover the opening 24 of the building and a generally horizontal position to permit access to the building through the opening 24. The vertical track sections 20 are spaced from the wall jamb 22 by the brackets 32 and are generally inclined in a direction, such that the space S between the wall jamb and the vertical track sections 20 increases from a lower portion 27 of the vertical track sections 20 toward an upper portion 28 such that the door 14 may be brought into sealing engagement against the wall jamb 22 when the door 14 is moved to a closed position.

Figure 2:
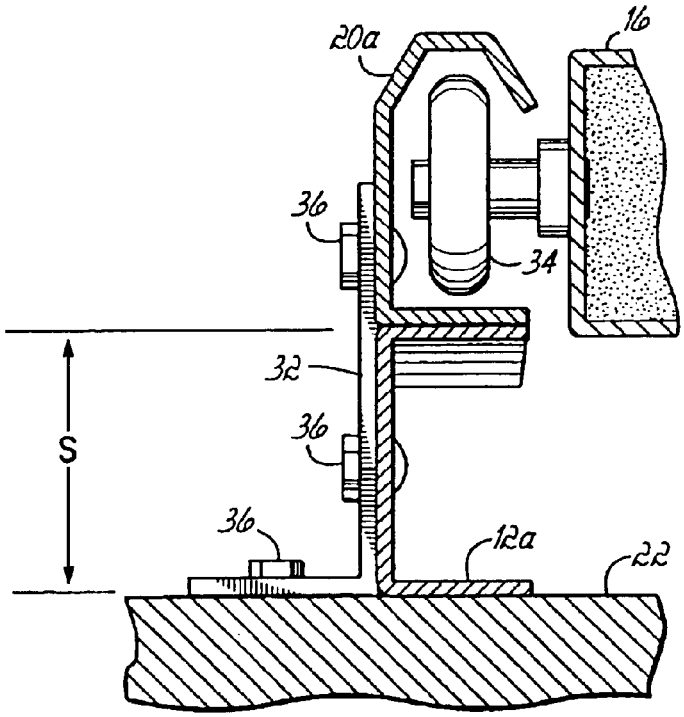
FIG. 2 is a partial section view of the door assembly of FIG. 1, taken along line 2—2.
Figure 3:
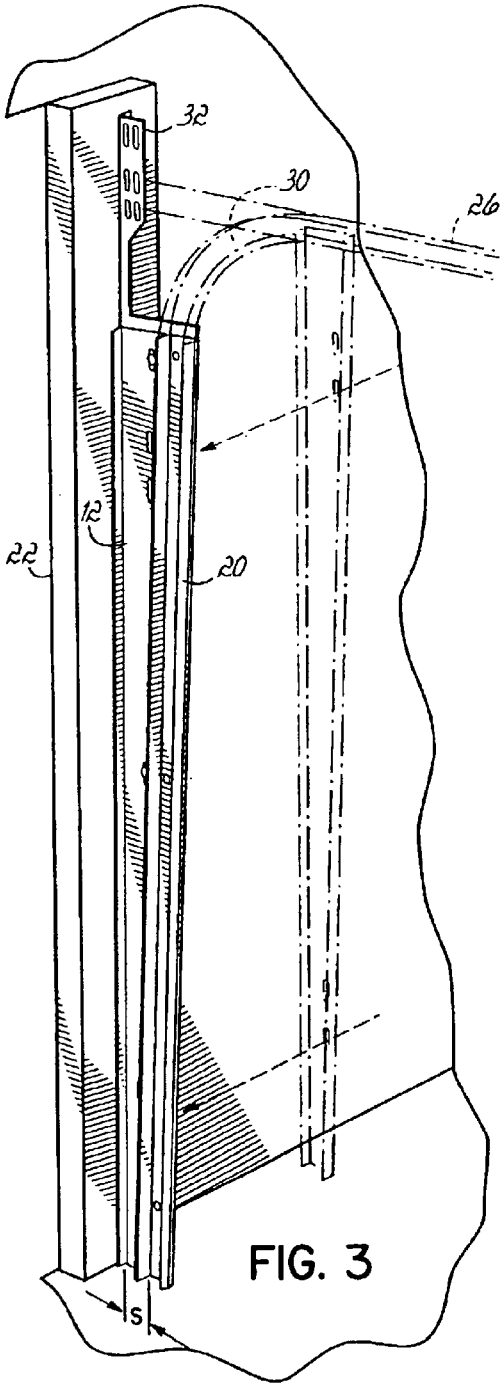
FIG. 3 is a perspective view showing detail of the door assembly.
Figure 4:
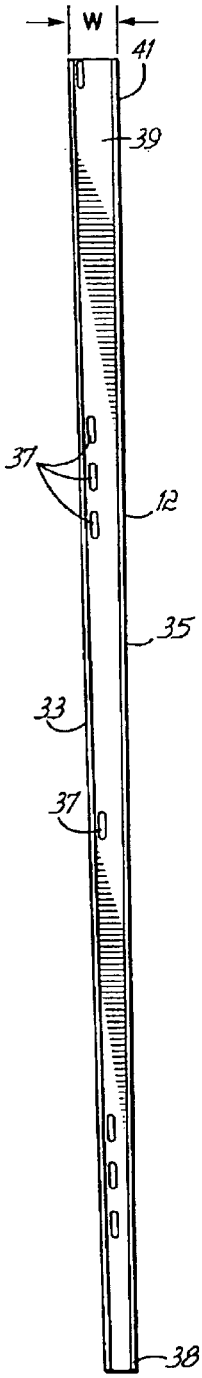
FIG. 4 is a plan view of the exemplary track guard of FIG. 1.

Referring to FIGS. 2–4, the exemplary track guard 12 is formed as an elongate member having a generally C-shaped cross-section with a pair of legs 33,35 joined by a web 39. The width W of the track guard 12 is sized to cover the space S between the vertical track section 20 and the wall jamb 22 when the track guard 12 is positioned therebetween. The track guard 12 may be attached to the brackets 32 which support the vertical track sections 20, such as by fasteners 36. The track guard 12 may be provided with holes 37 in the web 39 to facilitate attachment of the track guard 12 to the brackets 32. A number of holes 37 are provided proximate each mounting bracket 32, only one of which is typically utilized but offers versatility and accommodation of vagaries in the door assembly.

In the exemplary embodiment shown, the track guard 12, and more specifically, the web 39 has a width W which tapers from a more narrow first end 38 toward a wider second end 41 such that the track guard 12 covers the space S along the entire length of the vertical track section 20, accounting for the inclination of the vertical section 20 away from the wall jamb 22, as described above.

Figure 4A:
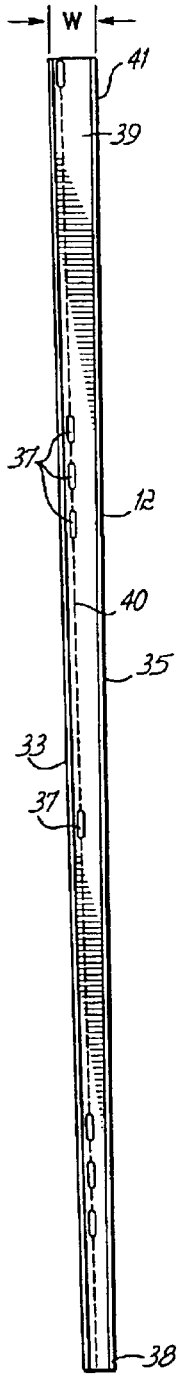
FIG. 4A is a view similar to FIG. 4 of an alternative embodiment of the track guard of this invention.
Figure 5:
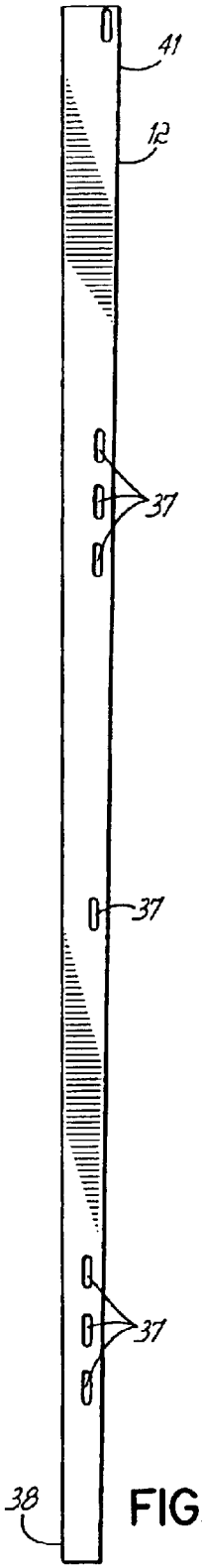
FIG. 5 is a plan view of the exemplary track guard of FIG. 1, viewed from the side opposite of that depicted in FIG. 4.
Figure 6:
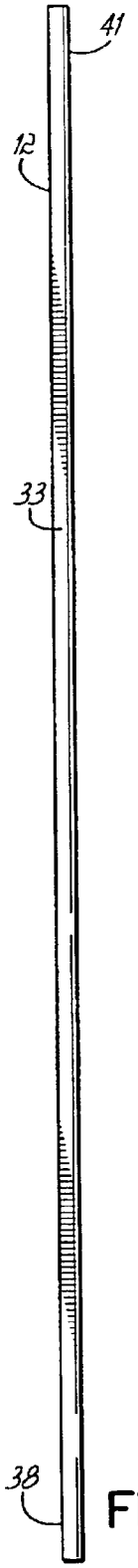
FIG. 6 is an edge view of the exemplary track guard of FIG. 1, viewed from the left side of FIG. 4.
Figure 7:
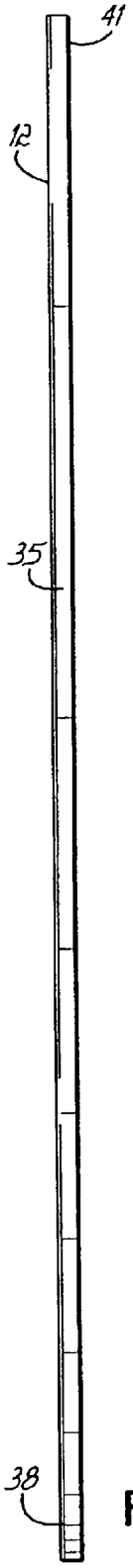
FIG. 7 is an edge view of the exemplary track guard of FIG. 1, viewed from the right side of FIG. 4.
Figure 8:
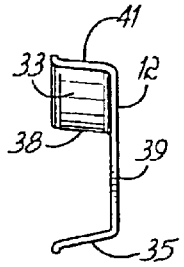
FIG. 8 is an end view of the exemplary track guard of FIG. 1, viewed from the upper end of FIG. 4 and rotated 90 degrees.
Figure 9:
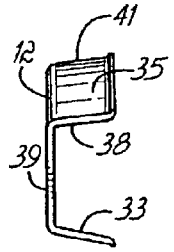
FIG. 9 is an end view of the exemplary track guard of FIG. 1, viewed from the lower end of FIG. 4 and rotated 90 degrees.

An alternative embodiment of the track guard 12 is shown in FIG. 4A. The track guard 12 of FIGS. 4 and 4A may be used in the door assembly 10 in the C-shaped configuration in an industry standard two inch track system 18. The track guard 12 of FIG. 4A includes a frangible portion defined by a perforation line 40 in the web 39 adjacent the leg 33. In one embodiment, the line 40 extends through the holes 37 in the web 39. The guard 12 of FIG. 4A is useful for a 1⅜ inch track system 18. An installer bends the web 39 about the line 40 repeatedly until the web separates along line 40. The separated leg 33 and adjoining portion of the web are discarded and the leg 35 is juxtaposed to the wall jamb 22 and the remainder of the web 39 is juxtaposed to the vertical track section 20 to cover the space S. Fasteners 36 may be used to secure the track guard 12 to the mounting brackets 32 through holes drilled in the remainder of the web 39. Moreover, screws or other mechanical fasteners (not shown) can be inserted through the leg 35 of the guard 12 of FIG. 4 or 4A and into the jamb 22 for added stability.

The track guard 12 may either be provided as a component of a sectional overhead door assembly 10 for new installations, or it may be an accessory which is added to existing sectional overhead door assemblies 10 to improve the pinch resistance thereof. Accordingly, a method of installing a sectional overhead door assembly 10 having a track guard 12 of the present invention includes the steps of attaching mounting brackets 32 to a wall jamb 22 near an opening 24 of a building, attaching at least one vertical track section 20 of a track assembly 18 to the mounting brackets 32, mounting a sectional door 14 within the track assembly 18, positioning a track guard 12 to cover the space S between the vertical track section 20 and the wall jamb 22, and attaching the track guard 12 to the mounting brackets 32. Likewise, a method for attaching the track guard 12 to an existing sectional overhead door assembly 10 includes the steps of positioning the track guard 12 to cover the space S between a vertical track section 20 and the wall jamb 22, and attaching the track guard 12 to the mounting brackets 32. With either installation procedure, the step of severing the web 39 along the line 40 may be required depending upon the geometry of the track system 18.

While the present invention has been illustrated by the description of the various embodiments thereof, and while the embodiments have been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of Applicant's general inventive concept.

What is claimed is:

1. A sectional overhead door assembly adapted for movement to and between a closed position covering an opening in a building structure and an open position exposing the opening, the assembly comprising:

a plurality of panels each having spaced lateral ends and spaced longitudinal edges, wherein said longitudinal edges of adjacent panels are pivotally coupled together;

a plurality of rollers each of which projects from one of said lateral ends of one of said panels;

a track system comprising a pair of spaced generally vertical track sections mounted to a wall jamb on opposite sides of the opening, a pair of spaced generally horizontal track sections and a pair of arcuate transition track sections, each transition track section coupling an upper end of one of said vertical track sections to one of said horizontal track sections;

wherein each of said rollers is captured in said track system for guiding said panels to and between the open and closed positions;

a plurality of mounting brackets mounting said vertical track sections to a wall jamb on opposite sides of the opening; and a guard positioned between at least a portion of said vertical track section and the wail jamb and extending substantially the full width therebetween to inhibit access between said vertical track section and the wall jamb.

2. The door assembly of claim 1, wherein said guard comprises high-impact polystyrene.

3. The door assembly of claim 1, wherein said guard is an elongate member and has a substantially c-shaped cross-section.

4. A sectional overhead door assembly adapted for movement to and between a closed position covering an opening in a building structure and an open position exposing the opening, the assembly comprising:

a plurality of panels each having spaced lateral ends and spaced longitudinal edges, wherein said longitudinal edges of adjacent panels are pivotally coupled together;

a plurality of rollers each of which projects from one of said lateral ends of one of said panels;

a track system comprising a pair of spaced generally vertical track sections mounted to a wall jamb on opposite sides of the opening, a pair of spaced generally horizontal track sections and a pair of arcuate transition track sections, each transition track section coupling an upper end of one of said vertical track sections to one of said horizontal track sections;

wherein each of said rollers is captured in said track system for guiding said panels to and between the open end closed positions;

a plurality of mounting brackets mounting said vertical track sections to a wall jamb on opposite sides of the opening; and a guard positioned between at least a portion of said vertical track section and the wall jamb to inhibit access between said vertical track section and the wall jamb;

wherein a lower end of each vertical track section is mounted closer to the wall jamb than the associated upper end of said vertical track section;

wherein said guard is an elongate member and is tapered from a first end to a second end to accommodate variation in the spacing between the wall jamb and said vertical track section.

5. The door assembly of claim 1, wherein said guard is held in position between said vertical track section and the wall jamb by fastening said guard to said mounting brackets.

6. The door assembly of claim 1, wherein said guard further comprises:

a plurality of holes to facilitate selective attachment of the guard to the mounting brackets.

7. The door assembly of claim 6, wherein the holes are arranged into a plurality of sets, each having a plurality of the holes being associated with one of the mounting brackets, wherein only one of the holes in each set is coupled to one of the mounting brackets.

8. A sectional overhead door assembly adapted for movement to and between a closed position covering an opening in a building structure and an open position exposing the opening, the assembly comprising:

a plurality of panels each having spaced lateral ends and spaced longitudinal edges, wherein said longitudinal edges of adjacent panels are pivotally coupled together;

a plurality of rollers each of which projects from one of said lateral ends of one of said panels;

a track system comprising a pair of spaced generally vertical track sections mounted to a wall jamb on opposite sides of the opening, a pair of spaced generally horizontal track sections and a pair of arcuate transition track sections, each transition track section coupling an upper end of one of said vertical track sections to one of said horizontal track sections;

wherein each of said rollers is captured in said track system for guiding said panels to and between the open and closed positions;

a plurality of mounting brackets mounting said vertical track sections to a wall jamb on opposite sides of the opening; and a guard positioned between at lease a portion of said vertical track section and the wall jamb to inhibit access between said vertical track section and the wall jamb;

wherein the guard further comprises a frangible portion severable from a remainder of the guard to accommodate a variety of door assembly configurations.

9. The door assembly of claim 8 wherein the frangible portion is defined, at least in part, by a perforation line in the guard.

10. A track guard adapted for use with a sectional overhead door assembly movable to and between a closed position covering an opening in a building structure and an open position exposing the opening, the sectional overhead door assembly including a plurality of panels each having spaced lateral ends and spaced longitudinal edges, wherein the longitudinal edges of adjacent panels are pivotally coupled together; a plurality of rollers each of which projects from one of the lateral ends of one of the panels; a track system comprising a pair of spaced generally vertical track sections mounted to a wall jamb on opposite sides of the opening, a pair of spaced generally horizontal track sections and a pair of arcuate transition track sections, each transition track section coupling an upper end of one of the vertical track sections to one of the horizontal track sections, wherein each of the rollers is captured in the track system for guiding the panels to and between the open and closed positions; a plurality of mounting brackets mounting the vertical track sections to wall jamb on opposite sides of the opening, the track guard comprising:

an elongate member adapted to be positioned between a least a portion of the vertical track section and the wall jamb and extending substantially the full width therebetween to inhibit access between the vertical track section and the wall jamb.

11. The track guard of claim 10, wherein said elongate member comprises high-impact polystyrene.

12. The track guard of claim 10, wherein said elongate member has a substantially c-shaped cross-section.

13. A track guard adapted for use with a sectional overhead door assembly movable to and between a closed position covering an opening in a building structure and an open position exposing the opening, the sectional overhead door assembly including a plurality of panels each having spaced lateral ends and spaced longitudinal edges, wherein the longitudinal edges of adjacent panels are pivotally coupled together; a plurality of rollers each of which projects from one of the lateral ends of one panels; a track system comprising a pair of spaced generally vertical track sections mounted to a wall jamb on opposite sides of the opening, a pair spaced generally horizontal track sections and a pair of arcuate transition track section, each transition track section coupling an upper end of one of the vertical track section to one of the horizontal track sections, wherein each of the rollers is captured in the track system for guiding the panels to and between the open and closed positions; a plurality of mounting brackets mounting the vertical track sections to wall jamb on opposite sides of the opening, the track guard comprising:

an elongate member adapted to be positioned between at least a portion of the vertical track section and the wall jamb to inhibit access between the vertical track section and the wall jamb;

wherein a lower end of each vertical track section is mounted closer to the wall jamb than the associated upper end of said vertical track section;

wherein said elongate member is tapered from a first end to a second end to accommodate variation in the spacing between the wall jamb and said vertical track section.

14. The track guard of claim 10, wherein said elongate member is held in position between said vertical track section and the wall jamb by fastening said guard to said mounting brackets.

15. The track guard of claim 10, wherein said guard further comprises:

a plurality of holes to facilitate selective attachment of the guard to the mounting brackets.

16. The track guard of claim 10, wherein the holes are arranged into a plurality of sets, each having a plurality of the holes being associated with one of the mounting brackets, wherein only one of the holes in each set is coupled to one of the mounting brackets.

17. A track guard adapted for use with a sectional overhead door assembly movable to and between a closed position covering an opening in a building structure and an open position exposing the opening, the sectional overhead door assembly including a plurality of panels each having spaced lateral ends and spaced longitudinal edges, wherein the longitudinal edges of adjacent panels are pivotally couple together; a plurality of rollers each of which projects from one of the lateral ends of one of the panels; a track system comprising a pair of spaced generally vertical track sections mounted to a wall jamb on opposite sides of the opening, a pair of spaced generally horizontal track sections and a pair of arcuate transition track section, each transition track section coupling an upper end of one of the vertical track sections to one of the horizontal track sections, wherein each of the rollers is captured in the track system for guiding the panels to and between the open and closed positions; a plurality of mounting brackets mounting the vertical track sections to wall jamb on opposite sides of the opening, the track guard comprising:

an elongate member adapted to be positioned between at least a portion of the vertical track section and the wall jamb to inhibit access between the vertical track section and the wall jamb; and a frangible portion severable from a remainder of the guard to accommodate a variety of door assembly configurations.

18. The track guard of claim 17 wherein the frangible portion is defined, at least in part, by a perforation line in the guard.

19. A method of installing a sectional overhead door assembly, the method comprising:

attaching mounting brackets to a wall jamb proximate an opening of a building;

attaching at least a vertical track section of a track assembly to the mounting brackets;

mounting a sectional door to the track assembly for movement along the track assembly from a substantially vertical position to cover the opening to a substantially horizontal position to uncover the opening;

positioning a track guard to cover a space between the vertical track section and the wall jamb, wherein the track guard is tapered from a first end to a second end and a spacing between the wall jamb and the vertical track section is tapered; and orienting the track guard relative to the tapered spacing to substantially cover the tapered spacing.

20. The method of claim 19 further comprising:

attaching the track guard to the mounting brackets.

21. The method of claim 19 further comprising:

separating a frangible portion of the track guard from a remainder of the track guard to accommodate a specific door assembly configuration.

22. The method of claim 19 further comprising:

securing the track guard to the wall jamb.

23. A method of retrofitting a sectional overhead door assembly, comprising:

positioning a track guard between a vertical track section and a wall jamb to which the vertical track section as mounted by mounting brackets, to inhibit access between the vertical track section and the wall jamb, wherein the track guard is tapered from a first end to a second end and a spacing between the wall jamb and the vertical track section is tapered;

attaching the track guard to the door assembly; and orienting the track guard relative to the tapered spacing to substantially cover the tapered spacing.

24. The method of claim 23 further comprising:

fastening the track guard to the mounting brackets.

25. The method of claim 23 further comprising:

separating a frangible portion of the track guard from a remainder of the track guard to accommodate a specific door assembly configuration.

26. The method of claim 23 further comprising:

securing the track guard to the wall jamb.

* * * * *

UNITED STATES PATENT AND TRADEMARK OFFICE

CERTIFICATE OF CORRECTION

PATENT NO. : 6,840,300 B2
DATED : January 11, 2005
INVENTOR(S) : Lewis, Jr.

It is certified that error appears in the above-identified patent and that said Letters Patent is hereby corrected as shown below:

Column 6,
Line 43, reads "...between a least a portion of the…" and should read -- ...between at least a portion of the… --.
Line 60, reads "...lateral ends of one panels;…" and should read -- ...lateral ends of one of the panels;… --.
Line 64, reads "...a pair of arcuate transition track section,…" and should read -- ...a pair of arcuate transition track sections,… --.
Line 66, reads "...of the vertical track section…" and should read -- ...of the vertical track sections… --.

Column 7,
Line 37, reads "...panels are pivotally couple together;…" and should read -- ...panels are pivotally coupled together;… --.
Line 42, reads "...pair of arcuate transition track section,…" and should read -- ...pair of arcuate track sections,… --.

Column 8,
Line 35, "reads ...vertical track section as mounted by…" and should read -- ...vertical track section is mounted by… --.

Signed and Sealed this

Thirtieth Day of August, 2005

JON W. DUDAS
*Director of the United States Patent and Trademark Office*